US005383555A

United States Patent [19]

Weinmeier

[11] Patent Number: 5,383,555

[45] Date of Patent: Jan. 24, 1995

[54] GOLF CLUB SECURER AND ORGANIZER

[76] Inventor: Robert J. Weinmeier, 4231 Dixie Canyon Ave., Apt. E., Sherman Oaks, Calif. 91423

[21] Appl. No.: 64,769

[22] Filed: May 19, 1993

[51] Int. Cl.[6] ..... 63B 55/00

[52] U.S. Cl. ..... 206/315.6; 206/315.3

[58] Field of Search ..... 206/315.6, 315.2, 315.4, 206/315.1, 315.3

[56] References Cited

U.S. PATENT DOCUMENTS

| | | | |
|---|---|---|---|
| 1,840,183 | 9/1930 | Blitch . | |
| 1,849,610 | 3/1932 | Boyce | 206/315.6 |
| 2,436,687 | 2/1948 | Corbett | 206/315.6 |
| 3,503,518 | 3/1970 | Black | 206/315.6 X |
| 4,194,547 | 3/1980 | Sidor . | |
| 4,208,227 | 6/1980 | Cowan | 206/315.6 |
| 4,753,446 | 6/1988 | Mills | 206/315.6 X |
| 5,029,703 | 7/1991 | Dulyea, Sr. | 206/315.6 X |
| 5,094,345 | 3/1992 | Yonnetti | 206/315.6 X |
| 5,135,107 | 8/1992 | Ingraham | 206/315.6 |

*Primary Examiner*—Allan N. Shoap
*Assistant Examiner*—Christopher McDonald
*Attorney, Agent, or Firm*—Poms, Smith, Lande & Rose

[57] ABSTRACT

A universal golf club securer and organizer including a relatively stiff peripheral frame, The frame is molded into a ring having a series of steps of increasing height. Mounted to each step is a strong resilient device for firmly securing the head of a single golf club to the frame. Each golf club head securer has an opening molded to fit a specific golf club surrounded by two claw-like prongs which allows easy insertion and extraction of the golf club head. Spanning the central opening of the frame is a central holding unit which has openings suited to holding additional golf clubs. The frame is attached to a golf club bag by means of a rod and clamp system which is adjustable to the height of any set of golf clubs.

19 Claims, 2 Drawing Sheets

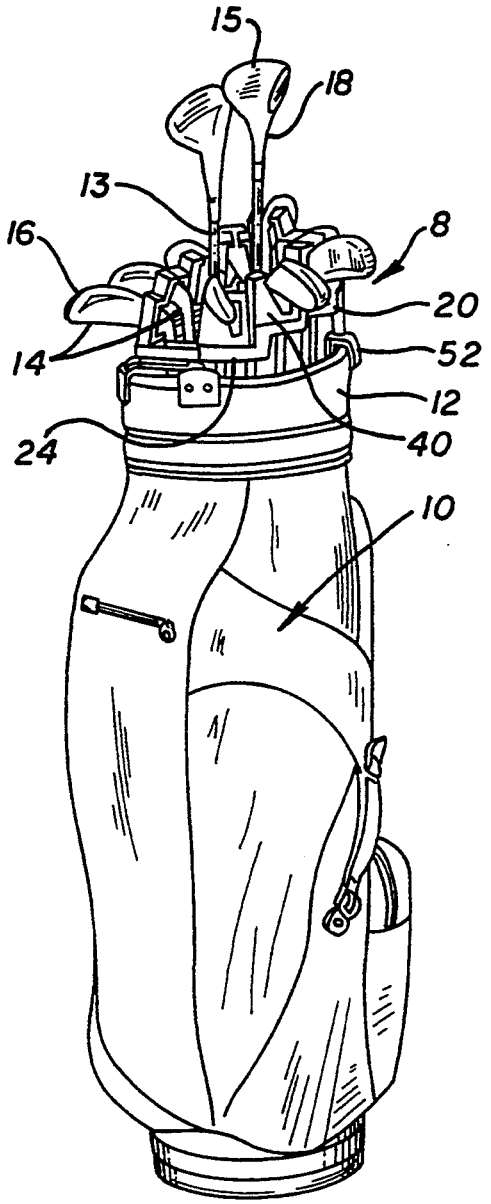
FIG. 1
FIG. 2
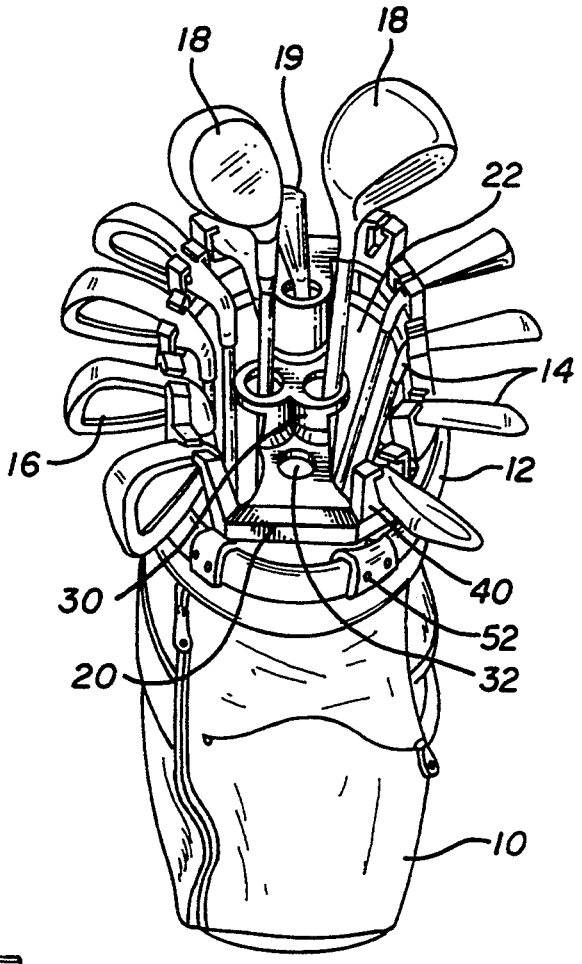
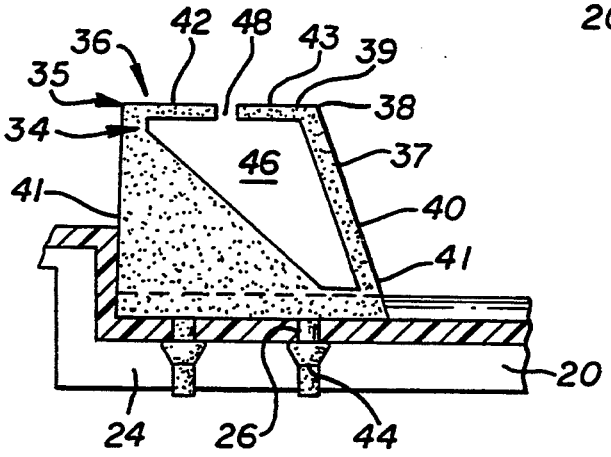
FIG. 5

GOLF CLUB SECURER AND ORGANIZER

FIELD OF THE INVENTION

This invention relates to a device for securing and organizing golf clubs.

BACKGROUND OF THE INVENTION

Up to the present, one of the most common problems golfers constantly faced was having to struggle with all the other clubs in their golf bag while searching for the correct club to use on the next golf shot. Products currently on the market that made an attempt to organize or protect golf clubs have limited practical benefits and unsubstantiated product longevity.

The most prominent product golfers find in today's market consists of many long tubes inserted into a golf bag. One example of a golf club protector consisting of many tubes is shown in U.S. Pat. No. 4,194,547 (the '547 Patent), issued Mar. 25, 1980. This prior art design uses a combination of tubes and spring clips to hold the golf clubs in place. Although there are racks suited to suspend the golf club heads, it is the chips which grip the golf club shafts that hold the golf clubs in place. Although this combination of tubes, spring clips and racks may be effective, it is also heavy and expensive to produce. In contrast, the present invention eliminates the need for tubes completely and combines the rack and spring clip into one securing device.

Another solution to this problem of lack of organization within a golf club bag, has been to suspend the heads of the golf club from a rack. U. S. Pat. No. 3,503,518 (the '518 Patent) granted Mar. 31, 1970, provided a solution to make the clubs immobile. The '518 Patent disclosed a peripheral upper blade holder portion of resilient material which wedgably engaged the lower portion of the head of the golf club. To provide immobility, a second, lower shaft holder portion was used in conjunction with the blade holder rack. The invention claimed herein eliminates the necessity of two separate devices, one to suspend the club and the other to keep the club secure.

U.S. Pat. No. 1,849,610 (the '610 Patent), granted Mar. 15, 1932, attempts to use a single system to both keep the club secure and to suspend the club. The solution disclosed includes both an inner and outer ring which contain notches upon which the heads of the golf clubs are rested. When the golf bag is tilted over or used for travel, however, the clubs may easily fall out of their notches. This is because the notches do not hold the club securely enough to prevent the club from escaping.

U.S. Pat. No. 2,436,687 (the '687 Patent), granted Feb. 24, 1948, also attempts to use a single device to both suspend the golf club and to secure the golf club in position. The '687 Patent discloses a wedge-like rack with finger-like upward extensions. The golf clubs are supported by these fingers which have been tapered to fit the head of the golf club. Although these fingers provide adequate support for securing the clubs during usage, a guard rail or a strap is needed to eliminate club disengagement in the event that the golf club bag is upended or used for transporting the golf clubs.

Accordingly, a principal object of the present invention is to provide an improved golf club securer and organizer. The invention suspends golf clubs from their heads so that either the butt or handle portions of the clubs rest at the bottom of the golf bag. Alternatively, using the rod and clamp configuration to adjust the height of the frame, the clubs are suspended to relieve the handle portions from weight tending to warp them. The head of each club is secured in place by a single securing device which, unlike the prior art, is able to hold the golf clubs so that even if the bag is upended or used for travel the clubs will remain in place. Since the golf club head securing devices may be individually formed for securing a specific golf club, each club is easily located in its proper position within the frame. The stem-like formation of the frame has two major advantages. The first is that all the clubs may be seen at a glance. Another advantage is the attractive formation of the club heads aloha the perimeter of the bag. The central holding unit holds clubs such as the woods and the putter. By holding these clubs in the center of the unit the golf bag always remains in balance. Finally, for attachment to the rim of the golf bag a series of clamps and rods may be used. This has the advantage of being adjustable to fit any size bag and any size set of golf clubs.

BRIEF SUMMARY OF THE INVENTION

In accordance with the present invention, a universal golf club securer and organizer includes a peripheral frame upon which are attached devices for securing the head of a single golf club. Each golf club head securer is made of a strong yet resilient material which both holds the golf club firmly in place and allows easy insertion and extraction of a golf club head. Further, the golf club head securer is molded to fit a specific numbered golf club. The minor variations between sets of golf clubs in size and contour are accommodated by the flexible nature of the resilient securing device.

In the preferred embodiment of the invention, the frame is made of a relatively stiff material which has been molded into a ring having a series of steps of increasing height. Each step has a securing device attached to it. In this configuration, when the golf clubs are inserted into their proper securing device, the golfer is able to see each club at a glance.

In accordance with one feature, across the central opening of the frame, a central holding unit made of the same relatively stiff material as the frame may be provided. This central holding unit has openings which may be used to hold additional golf clubs such as the woods and the putter. This arrangement protects the woods and the putter from damage and keeps the golf club bag in balance.

Another aspect of the present invention may include a system designed to attach the frame of the invention to a golf club bag. This system can be used to attach the frame to golf club bags of varying sizes. Additionally, the system is adjustable to the height of any set of golf clubs.

The preferred embodiment of the invention may also include the following additional features:

1. The frame and the securing devices may come in a variety of different colors.

2. The frame and the securing devices may be incorporated into a golf club bag as one unit.

3. The securing devices may have numbers imprinted thereon which correspond to the specific golf club number.

4. A series of extension rings may be used instead of the clamp and rod system to adjust the frame to accommodate the heights of various sets of golf clubs.

5. The frames may be made in different sizes and shapes to accommodate non-standard golf club bag openings.

Advantages of the present invention include the fact that the golf clubs are secured and held in a manner that protects the clubs both during usage and during travel. Since the clubs are suspended either on the periphery of the bag or in the central holder, the bag is always kept in balance. Another advantage is the organization the invention provides. This organization, combined with the physical step-like form, allows for easy location and easy inventory of the clubs within the golf bag. The method of attaching the frame to the golf club bag has the advantage of fitting any size golf club bag and any length of a set of golf clubs. Finally, since the clubs are suspended either on the periphery of the bag or in the central holder, the bag is always kept in balance.

Other objects, features and advantages of the present invention will become apparent from a consideration of the following detailed description, and from the accompanying drawings.

BRIEF DESCRIPTION OF THE DRAWINGS

FIG. 1 is a side view of the golf club securer and organizer in place in a golf bag and containing a set of golf clubs;

FIG. 2 is a top view of the golf club securer and organizer in place in a golf bag and containing a set of golf clubs;

FIG. 5 is a side cross-sectional view of a golf club head securer used to secure an individual head of a golf club.

DETAILED DESCRIPTION OF THE PREFERRED EMBODIMENT

Figure 4:
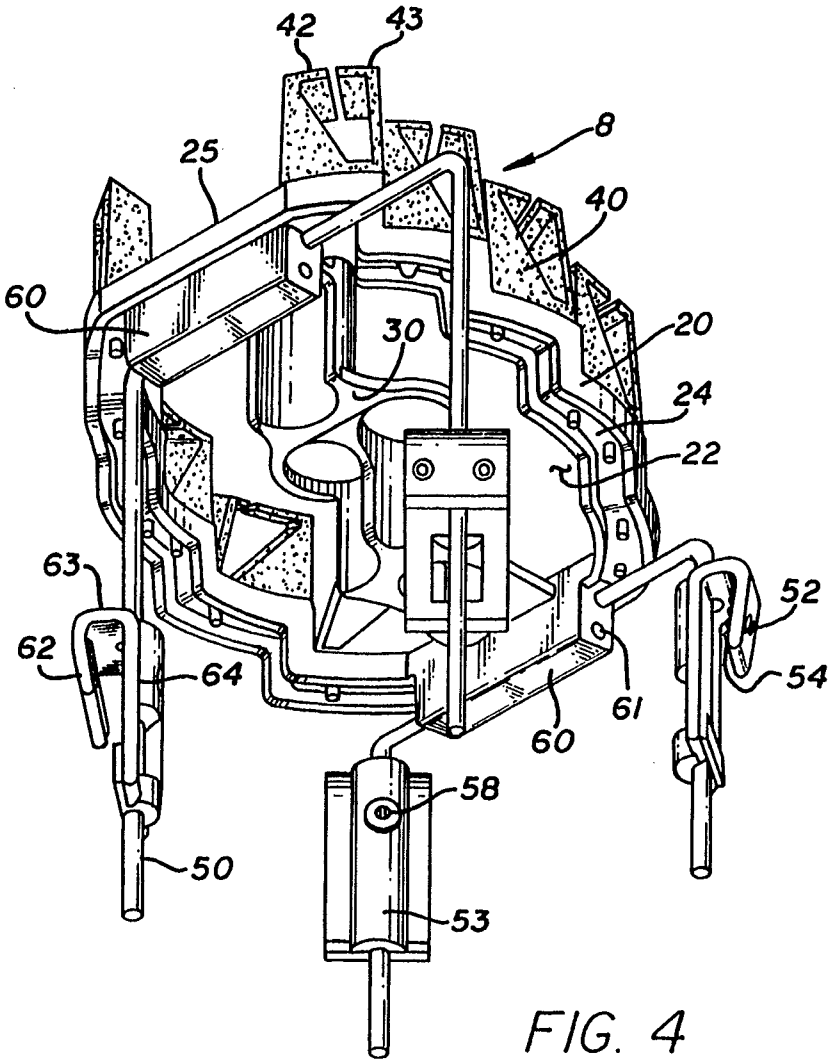
FIG. 4 is a view of the under side of the golf club securer and organizer.

Referring more particularly to the drawings, FIG. 1 is a depiction of a universal golf club securer and organizer 8 attached by means of rods 50 (best seen in FIG. 3 and FIG. 4) and clamps 52 to the upper rim 12 of the golf bag 10. Putting the shafts 13 of the irons into the inner recesses of the golf club bag 10 and the heads of the golf club irons 16 into the golf club head securer 40, the irons 14 are neatly spaced around the perimeter of the golf club bag so that the irons 14 are held securely in place at all times.

Securing the clubs in place has several advantages. First, if the golf bag 10 is upset or used for travel, the clubs will remain secure and in place. Second, the club heads 15 are protected from scratching and chipping. Third, the clubs 14 are easy to find and return because each has a proper position in the universal golf club securer and organizer 8. This also helps with keeping a constant inventory of the clubs and reduces the likelihood that clubs will be lost.

The frame 20 of the universal golf club securer and organizer 8, as can be seen from FIG. 1, has a step-like configuration. Each step 24 has a golf club head securer 40 mounted upon it. This formation allows the user to see all the clubs at one time. Additionally, this configuration puts the heads in a diagonal ring-like formation which is particularly attractive.

Figure 3:
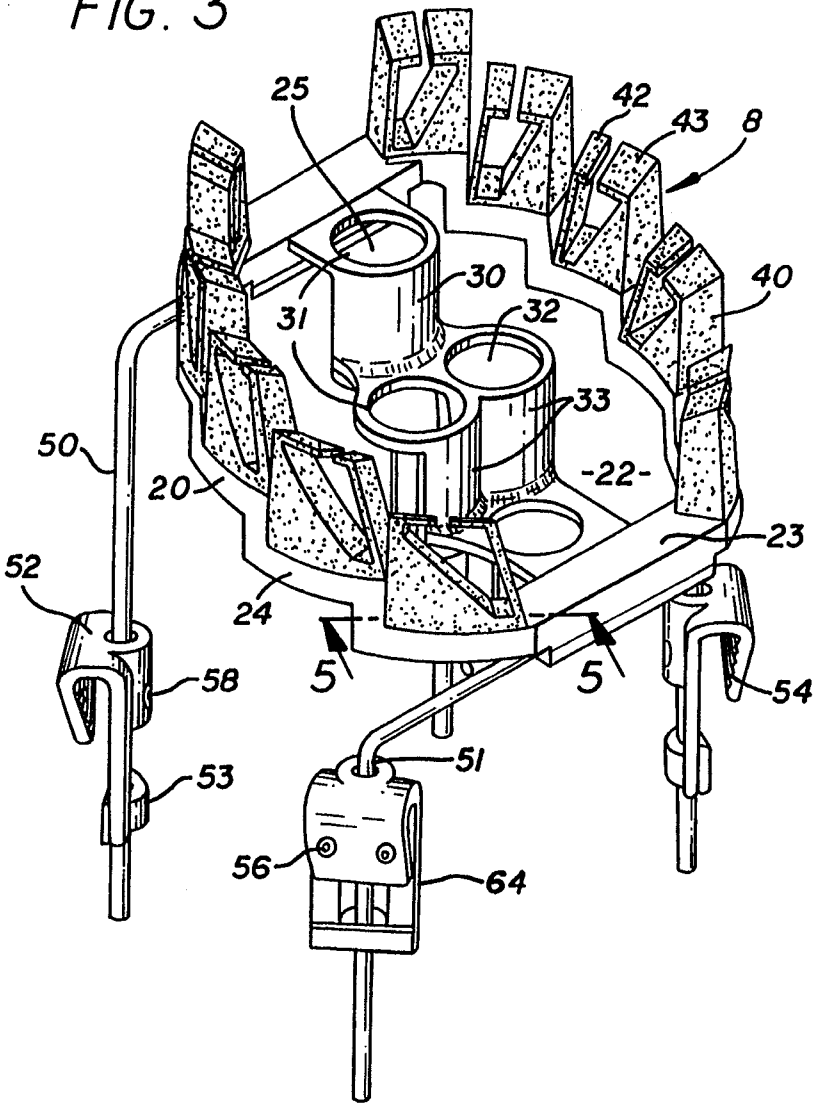
FIG. 3 is a perspective view of the golf club securer and organizer looking down and from one side of the bag attachment devices.

Spanning the frame is a central inner holder 30 with openings 32 (as seen in FIG. 2, FIG. 3 and FIG. 4) into which golf clubs such as the woods 18 and the putter 19 may be inserted. FIG. 1 shows the golf club woods 18 held in the openings 32 of the central inner holder 30 and extending above the irons 16.

FIG. 2 is a perspective view of the universal golf club securer and organizer 8 in place in the golf bag 10 and containing a set of golf clubs 14, 18, and 19. The irons 14 are held in place by claw-like securers 40 around the periphery of the golf bag 10. The woods 18 and putter 19 are situated within the openings 32 of the central inner holder 30. The central inner holder 30 is mounted to extend across the central opening 22 of the golf bag 10. The typical diameter of a rim of a golf bag opening 12 may be approximately seven to nine inches. The frame 20 of this invention preferably has a diameter of approximately eight inches. By using several rods 50 and clamps 52 (as best seen in FIG. 3 and FIG. 4) this frame may be used to fit any standard size golf bag 10. The rods 50 and clamps 52 will be discussed in greater detail in conjunction with FIG. 4.

FIG. 3 is a more detailed showing of the universal golf club securer and organizer 8. The frame 20 of the golf club securer and organizer is made of a relatively stiff material. In its preferred embodiment, the frame is molded out of a firm plastic or rubber material. Other materials which could be effectively used to make a frame include, for example, a lightweight metal or fiberglass. These materials are merely examples and are not intended to limit the scope of the invention.

The frame 20 in the preferred embodiment would have a ring-like shape defining a central opening 22. The ring-like shape may be symmetrically divided into two halves of graduated steps 24 which meet at a lower portion 23 and at an upper portion 25. The width of each step may be determined by the size of the base of each golf club head securer 40. Each step 24 may have at least one bore 26 (as best seen in FIG. 5) through which a locking device 44, at the bottom of each golf club head securer 40, may be inserted. Further, both the outer and the inner edge of each step may have a small ridge 41 (as best seen in FIG. 5). The bore 26 and the ridge 41 both serve to prevent the golf club head securer 40 from rotating.

Each step 24 of the frame 20 has a golf club head securer 40 mounted upon it. By inserting the locking device 44 through the bore 26 (as best seen in FIG. 5) the golf club head securer 40 is fastened to the frame 20. Alternatively, other methods of mounting, such as glues or screws or mating recesses, known to those skilled in the art, could be used by way of illustrative examples.

Extending across the central opening 22 is a central inner holder 30. The central inner holder is attached to the lower portion 23 of the frame 20 and to the upper portion 25 of the frame 20. The central inner holder 30, like the frame 20, has a step-like formation. In the preferred embodiment, each horizontal inner step 31, has an essentially circular opening 32. These circular openings 32 are meant to accommodate golf clubs such as the woods 18 and the putter 19 (as best seen in FIG. 2). The diameter of these openings, therefore may be approximately $1\frac{1}{4}$ inches. The horizontal inner steps 31 are connected by vertical inner surfaces 33 of approximately $1\frac{1}{2}$ to 2 inches. In the preferred embodiment, the vertical inner surfaces 33 are partially cylindrical. The central inner holder 30 is preferably formed of the same stiff material as the frame 20. The central inner holder 30 and the frame 20 may be a single unit or may be formed separately and secured together.

The frame 20 is attached to the rim of a golf bag 12 by means of a series of rods 50 and clamps 52. In the preferred embodiment, the rods 50 are made of a sturdy material such as steel or aluminum. The rods consist of two perpendicular portions separated by a 90° bend in the rod. This gives the rods an L-shape formation. The portions of the rod should be long enough to allow for both the varied width of the openings of a golf bag 12 and for the varying heights of golf club sets. A set of essentially flattened hook-shape clamps 52 are provided to secure the rod 50 to the rim of the golf club bag 12. FIG. 3 and FIG. 4 show these clamps 52 from several different angles. The clamps are made of a sturdy high-strength metallic material such as engineered plastic, steel, or aluminum.

As shown in FIG. 4 the clamp can be considered as including three sections. The long section 64 of the clamp has a bore or partial bore 51 through which the rod 50 is inserted. To accommodate the rod 50, a longitudinally-extending, semi-circular protrusion 53 may be included in the center of the long section 64 of the clamp 52. To keep the rod 50 from slipping within the bore 51 of the long side 64 of the clamp 52 a set screw 58 is provided. This long section 64 of the clamp 52 is situated inside of the golf club bag 10 when the frame 20 is in place. In the preferred embodiment the long side 64 of the clamp 52 is approximately 2½ to 3 inches in length.

The inner surface of the top portion 63 of the clamp 52 rests on the rim of the golf bag 12 when the frame 20 is in place. This top portion 63 on its upper exposed surface may be approximately 1 inch to 1½ inches thick. Its inner surface, the side touching the rim of the golf bag 12, is approximately ½ to ¼ of an inch wide.

The short portion 62 of the clamp 52 is on the outer portion of the golf bag 10 when the frame 20 is in place (as best seen in FIG. 1 and FIG. 2). This portion may be approximately 1 inch to 1½ inches long. On the side touching the golf bag 10, there is a gripping surface 54 (as best seen in FIG. 3). Additionally, to keep the clamp 52 in place, one or two set screws 56 may be provided.

A frame and rod joining mechanism 60, as seen in FIG. 4, is provided to attach the rods 50 to the frame 20. This device 60 may be an integral block with two bores 61 through which the rods 50 are inserted. Alternatively, the mechanism 60 may involve a shallow block with two grooves to receive the short ends of the rods 50, with an overlying plate secured in position by one or more screws.

This rod 50 and clamp 52 system of joining the golf club securer and organizer 8 to the golf bag 10 is only meant to be exemplary. Another method could involve the use of extension rings in which either several rings of uniform size or rings of the height desired are provided to be secured between the frame 20 and the rim of the golf bag 12. In addition, the frame 20 could be permanently attached to the golf bag 10.

FIG. 5 is a longitudinal cross-sectional view of a golf club head securer 40 and the adjacent portion of the frame 20. The securer is made of a resilient material which, in the preferred embodiment, is a plastic or rubber material. The securer 40 has a generally trapezoidal exterior perimeter. The lower diagonal portion of the securer 40 is a solid wedge 49 of the resilient material. The upper diagonal portion of the securer 40 is an opening 46 of the general shape of the head of a golf club iron 16 (not shown in FIG. 5).

The golf club is held within the opening 46 by two claw-like prongs 42 and 43. At the top point of the wedge of resilient material 49 is a shorter claw-like prong 42 which extends for a short distance vertically relative to the step 24 of the frame 20. This is the upward portion of the short prong 34. The claw-like prong 42 then makes a sharp, approximately 90°, angle 35 into a portion which extends horizontally and parallel to the step 24 of the frame 20.

Opposite the solid wedge of plastic 49 is a long claw-like prong 43. This claw-like prong 43 has an upward extension 37 at a step angle from the step 24 of the frame 20. From this long upward appendage 37 a horizontal portion 39 extends substantially horizontally. This horizontal element 39 of the long claw-like prong 43 is substantially parallel to the step 24 of the frame 20.

The horizontal portion 36 of the shorter prong 42 and the horizontal portion 39 of the longer prong 43 may be at substantially the same height above the step 24 of the frame 20. These horizontal portions (38 and 39) extend toward each other and meet at the gap 48. The gap 48 is provided to allow the head of a golf club 16 to be inserted and extracted from the golf club head opening 46. The size of the gap 48 in the preferred embodiment is approximately one quarter of an inch. This however is merely exemplary. A gap of an ⅛0 inch or no gap at all or even an overlapping could be employed.

At the bottom of the golf club head securer 40 is at least one locking device 44. In the preferred embodiment (as shown in FIG. 5) two such locking devices 44 are provided. These elements 44 are extensions with a mushroom-like protrusion at the center thereof to lock the unit in place. Each locking device 44 is inserted through a bore 26 of a step 24 of the frame 20. In the preferred embodiment the locking device may extend beyond the frame 20 (also seen in FIG. 4). After securing, the end of the element 44 may be clipped off.

One purpose of the locking element 44 is to guard against rotation of the golf club head securer 40, as well as the basic securing function of the elements 44. An additional safeguard to prevent rotation is the small ridge 41 on the inner and outer edges of each step 24 of the frame 20. The ridge in FIG. 5 is larger than that which would actually be necessary, but is represented as such for illustrative purposes.

In conclusion, it is to be understood that the present invention is not to be limited to that precisely as described hereinabove and as shown in the accompanying drawings. More specifically, the frame could take shapes other than circular (such as a square or hexagonal) in order to accommodate unusual golf club bags. Further, the frames and holders can be of any color. The materials discussed are meant to be exemplary and could easily be exchanged with any other material suitable for the intended purpose. Numbering corresponding to the numbers of the specific golf club for which the holder is molded could be added to the exterior or top surface of the holders. Extension rings can be used in place of the rod and clamp system discussed above. Accordingly, the present invention is not limited to the arrangements precisely as shown and described hereinabove.

What is claimed is:

1. A universal golf club securer and organizer, comprising:

a. a frame defining a central opening, said central opening for containing shafts of golf clubs each having a head with a golf ball engaging blade;

b. a plurality of securing means, each securing means having two members which engage the blade of the head of the club and at least one of said members being a prong which resiliently extends over the top of the blade of the head of a golf club, said plurality of securing means having different inner shapes to accommodate heads of golf clubs of different shapes, said plurality of securing means attached to said frame each for gripping and restraining outward movement of the head of a single golf club;

c. said two members of each securing means extending over a golf club head and having an opening between the members; and d. adjustable attachment means for attaching the frame to a golf club bag.

2. A universal golf club securer and organizer as defined in claim 1, wherein each said securing means is made of a resilient material for allowing easy insertion and extraction of a golf club, and for preventing said golf club from falling out of said securing means.

3. A universal golf club securer and organizer as defined in claim 1, wherein the opening between the two members allows easy insertion and extraction of a golf club and said members prevent said golf club from falling out of said securing means.

4. A universal golf club securer and organizer as defined in claim 1, wherein said frame is made of a relatively stiff material.

5. A universal golf club securer and organizer as defined in claim 1, wherein said frame has steps of varying height for accommodating different lengths of golf clubs in a set.

6. A universal golf club securer and organizer as defined in claim 5, wherein each said step of said frame has said securing means attached.

7. A universal golf club securer and organizer as defined in claim 5, wherein each step of said frame has at least one bore defined therein.

8. A universal golf club securer and organizer as defined in claim 7, wherein said attachment of each said securing means to each step of said frame is accomplished by inserting a locking device on the bottom of said securing means through said bore defined by said frame.

9. A universal golf club securer and organizer as defined in claim 1, further including a center holder, attached to either side of said frame and spanning said central opening of said frame, which has openings defined therein for insertion of golf clubs.

10. A universal golf club securer and organizer as defined in claim 9, wherein said frame and said center holder are a single unit.

11. A universal golf club securer and organizer as defined in claim 1, wherein said adjustable attachment means are a plurality of rods and clamps which are adjustable in height to accommodate different lengths of sets of clubs.

12. A universal golf club securer and organizer as defined in claim 1, wherein said adjustable attachment means are a plurality of rods and clamps which are adjustable in width to accommodate a variety of different diameters of golf club bags.

13. A universal golf club securer and organizer, as defined in claim 1 wherein said plurality of securing means form a generally circular array, with successive securing means being at different heights to accommodate varying club lengths.

14. A universal golf club securer and organizer, comprising:

a. a golf bag with an opening defined at one end;

b. a frame of substantially the size and shape of the perimeter of said opening defining a central opening secured to said bag above said opening; and c. a plurality of golf club head securing means made of resilient material, each said securing means having two prongs at least one of which extends over the top of a golf club head and each said securing means having an opening defined between the prongs for allowing easy insertion and extraction of a golf club, said securing means for preventing said golf club from falling out of said securing means, and said securing means attached to said frame.

15. A universal golf club securer and organizer as defined in claim 14, wherein said frame has steps of varying heights for accommodating different lengths of golf clubs in a set and each step of said frame has at least one bore defined therein.

16. A universal golf club securer and organizer as defined in claim 15, wherein each said step of said frame has said securing means attached by inserting a locking device on the bottom of said securing means through said bore defined by said frame.

17. A universal golf club securer and organizer as defined in claim 15, further including a center holder, attached to either side of said frame and spanning said central opening of said frame, which has openings defined therein for insertion of golf clubs.

18. A universal golf club securer and organizer, comprising:

a main supporting ring having a diameter about equal to the diameter of the upper end of a golf bag;

adjustable attachment means for attaching said main supporting ring to a golf club bag;

a plurality of resilient golf club head securers of different inner shape, secured to said main supporting ring for gripping the heads of golf club irons of different shapes;

said main supporting ring is made in a form of steps of different heights for accommodating different lengths of golf clubs in a set, and each step of said main supporting ring has at least one bore defined therein; and each said golf club head securer is secured to each step of said main supporting ring by a locking device on the bottom of said golf club head securer which extends through said bore defined by said main supporting ring.

19. A universal golf club securer and organizer, comprising:

a. a main supporting ring having a diameter about equal to the diameter of the upper end of a golf bag;

b. a plurality of rods and clamps for adjustably coupling said ring to the upper end of a golf bog;

c. a plurality of resilient golf club head securers of different inner shape, secured to said ring for gripping and engaging the blades of the heads of golf club irons of different shapes, said securers being mounted on said ring to extend upwardly therefrom, said securers being spaced around said ring; and d. a central inner holder, mounted to extend across said ring, and including openings for receiving additional golf clubs such as the putter and the woods;

wherein said main supporting ring is made of a relatively stiff material in a form of steps of different heights for accommodating different lengths of golf clubs in a set, and each step of said main supporting ring has at least one bore defined therein; and wherein each said golf club head securer is secured to each step of said main supporting ring by a locking device on the bottom of said golf club securer which extends through said bore defined by said main supporting ring.

* * * * *